US005989041A

United States Patent [19]

Lin

[11] Patent Number: 5,989,041

[45] Date of Patent: Nov. 23, 1999

[54] ELECTRICAL CONNECTOR ASSEMBLY

[75] Inventor: Ming-Ching Lin, Taipei Hsien, Taiwan

[73] Assignee: C.S. Conser Enterprise Co., Ltd., Hisn-Tien, Taiwan

[21] Appl. No.: 09/127,401

[22] Filed: Jul. 31, 1998

[51] Int. Cl.[6] ..... H01R 9/09

[52] U.S. Cl. ..... 439/79; 439/80; 439/541.5

[58] Field of Search ..... 439/79, 80, 541.5, 439/567

[56] References Cited

U.S. PATENT DOCUMENTS

| | | | |
|---|---|---|---|
| 5,643,008 | 7/1997 | Tan et al. | 439/541.5 |
| 5,823,822 | 10/1998 | Tan et al. | 439/541.5 |
| 5,851,125 | 12/1998 | Hsu et al. | 439/541.5 |
| 5,863,222 | 1/1999 | Kinsey, Jr. et al. | 439/607 |

*Primary Examiner*—Steven L. Stephan
*Assistant Examiner*—Vincent Johnson
*Attorney, Agent, or Firm*—Ladas & Parry

[57] ABSTRACT

An electrical connector assembly includes a plurality of right-angled conductive terminals and a two-part terminal housing consisting of a main connector frame and a terminal positioning frame. The main connector frame includes a connector block portion for holding the horizontal contact portions of the conductive terminals, and a pair of parallel support arms that extend downwardly from the connector block portion and that cooperate with the connector block portion to confine an accommodating space for accommodating at least one electrical connector below the connector block portion and in front of the support arms. A guide plate extends between the support arms, and is formed with a plurality of notches to permit the vertical solder tail portions of the conductive terminals to extend downwardly through the guide plate. The terminal positioning frame is formed separately from the main connector frame, and is disposed below the guide plate. The terminal positioning frame is provided with solder tail holes that are registered with the notches in the guide plate to permit extension of the vertical solder tail portions of the conductive terminals therethrough.

8 Claims, 5 Drawing Sheets

ELECTRICAL CONNECTOR ASSEMBLY

BACKGROUND OF THE INVENTION

1. Field of the Invention

The invention relates to electrical connectors, more particularly to an electrical connector assembly with a self-sustaining terminal housing that is capable of nesting another electrical connector in a superposed relationship.

2. Description of the Related Art

Electrical connectors have been employed to connect a printed circuit board to various electronic components associated with a computer, such as a hard disk drive, a printer, etc. In some instances, several electrical connectors are mounted on a principal circuit board in a two-level superposed relationship. As shown in FIG. 1, a conventional electrical connector is provided with a bracket 5 to hold an upper connector 1 and to nest two lower connectors 8, 9. The bracket 5 includes a pair of support arms 7 positioned at two ends, a forward horizontal portion 51 extending between the upper ends of the support arms 7 for supporting the housing of the upper connector 1, two upstanding mounting portions 6 located near the forward edge of the horizontal portion 51, and a terminal positioning plate 70 extending between the support arms 7 near the lower ends of the latter, such that the downwardly extending segments of right-angled terminals 2 can be inserted through openings 11 formed in the terminal positioning plate 70. In addition, an L-shaped portion 71 is disposed between the support arms 7, and is formed integrally with the forward horizontal portion 51 and the terminal positioning plate 70 at two ends. A pair of side anchoring terminals 10 are disposed behind the support arms 7, and are secured to the upstanding mounting portions 6 of the bracket 5. A pair of internally threaded blind rivets 41 and a pair of bolts 4 fasten a metal shield 3, the upper connector 1 and the side anchoring terminals 10 on the bracket 5. The side anchoring terminals 10 and an intermediate anchoring terminal 13 attached to the L-shaped portion 71 mount the bracket 5 on a printed circuit board. According to this structure, the upper connector 1 can be fixed at an upper level by means of the bracket 5, while the space below the forward horizontal portion 51 of the bracket 5 can be utilized to accommodate two smaller connectors 8, 9 at a lower level. The upper connector 1 and the lower connectors 8, 9 are substantially in a stacked relationship.

SUMMARY OF THE INVENTION

The object of this invention is to provide an electrical connector assembly that can accommodate an electrical connector in a lower level while facilitating replacement of conductive terminals.

According to the present invention, an electrical connector assembly comprises a plurality of right-angled conductive terminals and a two-part terminal housing consisting of a main connector frame and a terminal positioning frame. The main connector frame includes a connector block portion for holding the horizontal contact portions of the conductive terminals, and a pair of parallel support arms that extend downwardly from the connector block portion and that cooperate with the connector block portion to confine an accommodating space for accommodating at least one electrical connector below the connector block portion and in front of the support arms. A guide plate extends between the support arms, and is formed with a plurality of notches to permit the vertical solder tail portions of the conductive terminals to extend downwardly through the guide plate. The terminal positioning frame is formed separately from the main connector frame, and is disposed below the guide plate. The terminal positioning frame is provided with solder tail holes that are registered with the notches in the guide plate to permit extension of the vertical solder tail portions of the conductive terminals therethrough.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 2:
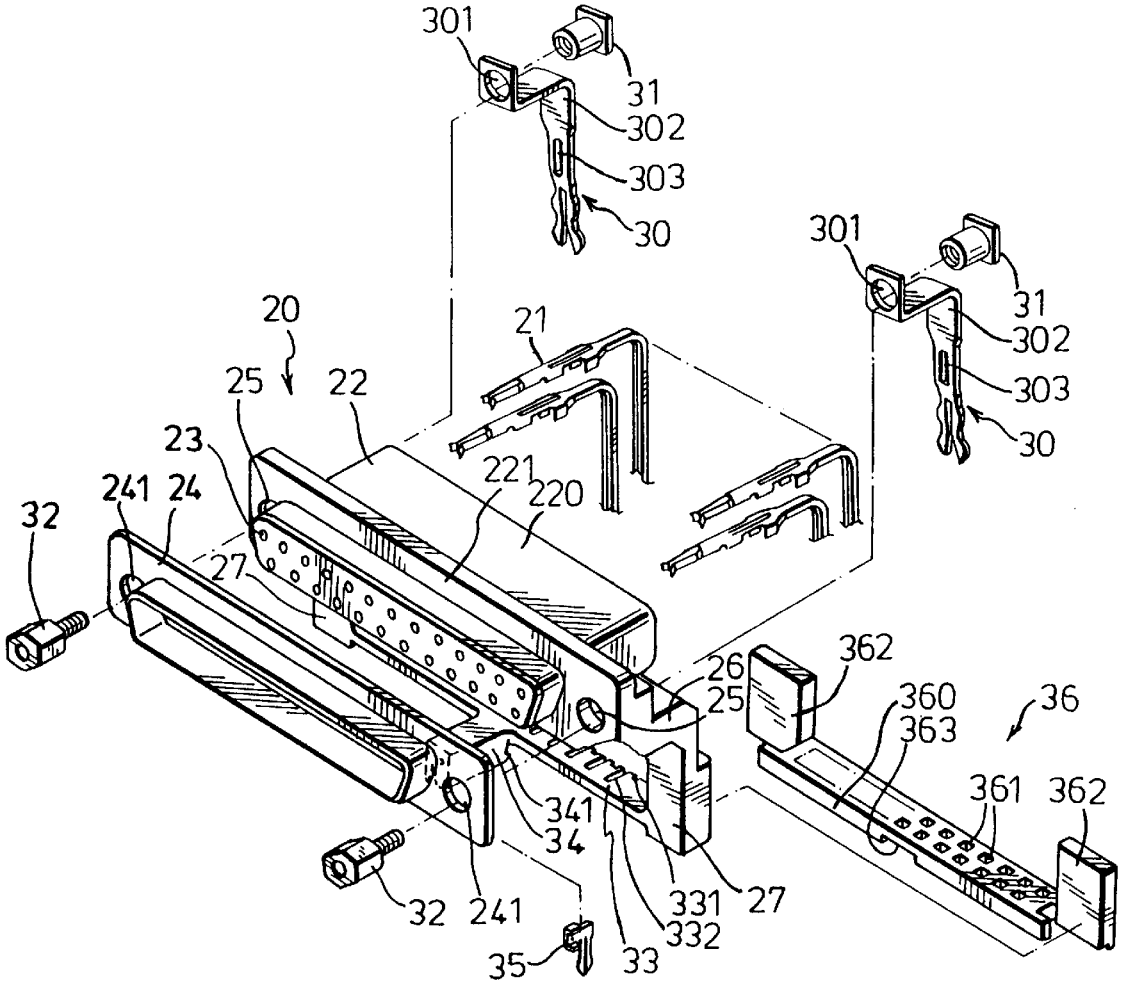
FIG. 2 is an exploded view of the preferred embodiment of an electrical connector assembly according to the invention.

Referring to FIG. 2, the preferred embodiment of an electrical connector assembly 20 according to this invention is shown to have a terminal housing 22 that can be self-sustained on a substrate, such as the principal circuit board of a computer (not shown). Particularly, the terminal housing 22 includes a main connector frame formed integrally from an electrical insulator material. Conductive terminals 21 are resident in the main connector frame in upper and lower rows, the upper and lower conductive terminals 21 being staggered in position in a widthwise direction of the main connector frame. The conductive terminals 21 are right-angled, and have horizontal contact portions and vertical solder tail portions that extend downwardly from rear sections of the horizontal contact portions. The main connector frame includes a connector block portion 220 formed with two rows of terminal holes 23 that extend from the front side 221 to the rear side for insertion of the horizontal contact portions of the conductive terminals 21 such that the vertical solder tail portions are behind the connector block portion 220.

Figure 3:
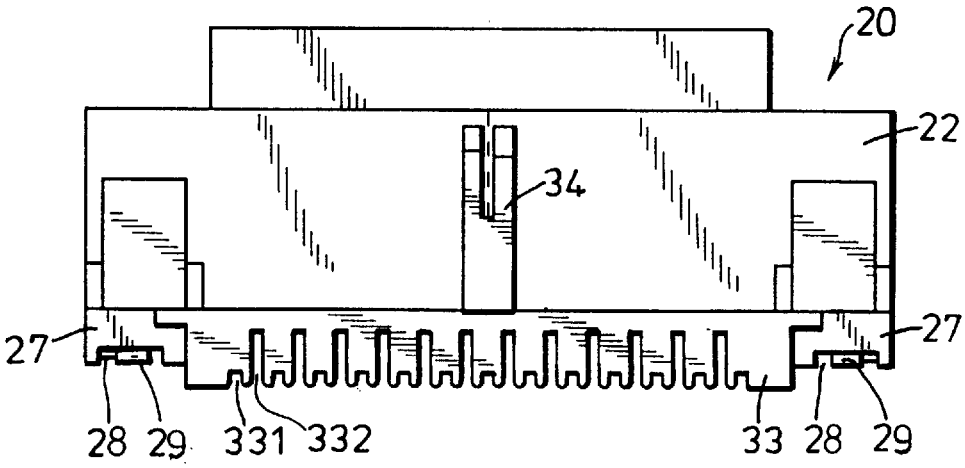
FIG. 3 is a schematic bottom view of a main connector frame of the electrical connector assembly shown in FIG. 2.

Referring also to FIG. 3, a spaced pair of parallel support arms 27 extend downwardly from a rearward horizontal extension 26 of the connector block portion 220 so as to be offset from the front side 221, and are disposed respectively at opposite left and right ends of the horizontal extension 26. The support arms 27 have upper ends connected to the connector block portion 220 and distal lower ends. The support arms 27 cooperate with the connector block portion 220 to confine an accommodating space for accommodating at least one electrical connector (not shown) below the connector block portion 220 and in front of the support arms 27. A guide plate 33 is connected to and extends between the distal lower ends of the support arms 27. The guide plate 33, which has horizontal major surfaces, is formed with a plurality of notches 331, 332 that extend transversely from the rear edge toward the front edge of the guide plate 33. The notches 331 are shorter than and alternate with the notches 332, such that the vertical solder tail portions of the conductive terminals 21 in the upper row of terminal holes 23 are permitted to extend through the shorter notches 331, while the vertical solder tail portions of the conductive terminals 21 in the lower row of terminal holes 23 are permitted to extend through the longer notches 332.

The rear surface of each support arm 27 is provided with a groove 28 and a retaining projection 29, the purpose of which will be described hereinafter.

A foot member 34 extends forwardly and transversely from the front edge of the guide plate 33 at a position between the support arms 27.

Figure 6:
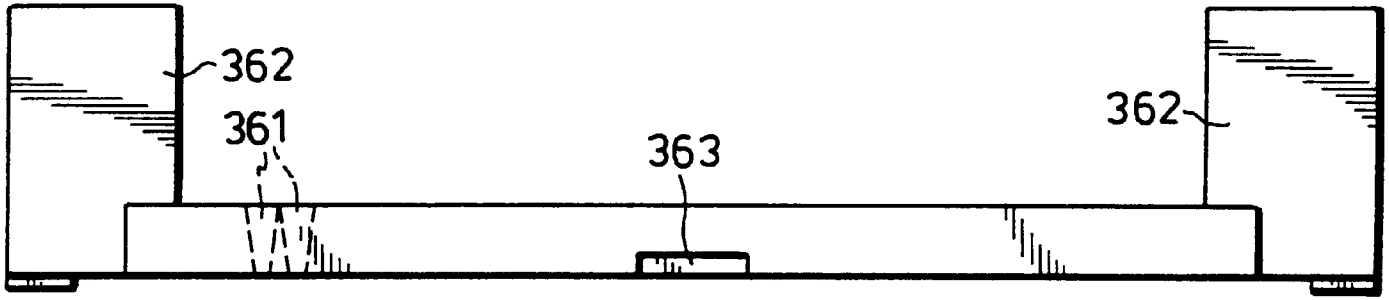
FIG. 6 is a schematic front view of the terminal positioning frame of the preferred embodiment.
Figure 5:
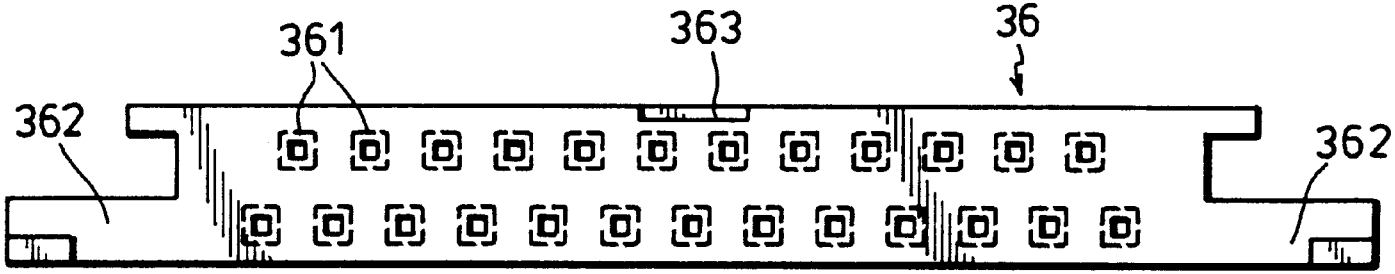
FIG. 5 is a schematic bottom view of the terminal positioning frame of the preferred embodiment.

The terminal housing 22 further includes a terminal positioning frame 36 formed integrally from an electrical insulator material and formed separately from the main connector frame. The terminal positioning frame 36 includes a horizontal extension 360 and a pair of upright clamping plates 362 on opposite ends of the horizontal extension 360. The horizontal extension 360 is formed with two rows of solder tails holes 361 having vertical axes. The holes 361 in the two rows are staggered, as shown in FIG. 5. The holes 361 are registered respectively with the notches 331, 332 in the guide plate 33 in such a manner that each vertical solder tail portion can be inserted through vertically aligned pairs of the notches 331, 332 and the holes 361. Preferably, the holes 361 taper gradually in a vertical downward direction, as shown in FIG. 6.

The electrical connector is secured to a substrate, such as a printed circuit board (not shown), via a pair of side anchoring terminals 30 and a central anchoring terminal 35. Each side anchoring terminal 30 has an upper part substantially conforming to the contour of the back of the main connector frame, a hole 301 for extension of a bolt 32 therethrough, and an opening 303 formed in a vertical section 302 for engaging the retaining projection 29 on the support arm 27. The horizontal extension 360 of the terminal positioning frame 36 is disposed below the guide plate 33, and the clamping plates 362 are placed behind the support arms 27 so as to clamp the vertical sections 302 of the side anchoring terminals 30 against the support arms 27. In this position, the vertical sections 302 of the side anchoring terminals 30 are engaged within the grooves 28, and the retaining projections 29 extend into the openings 303 to fix the terminals 30.

Figure 7:
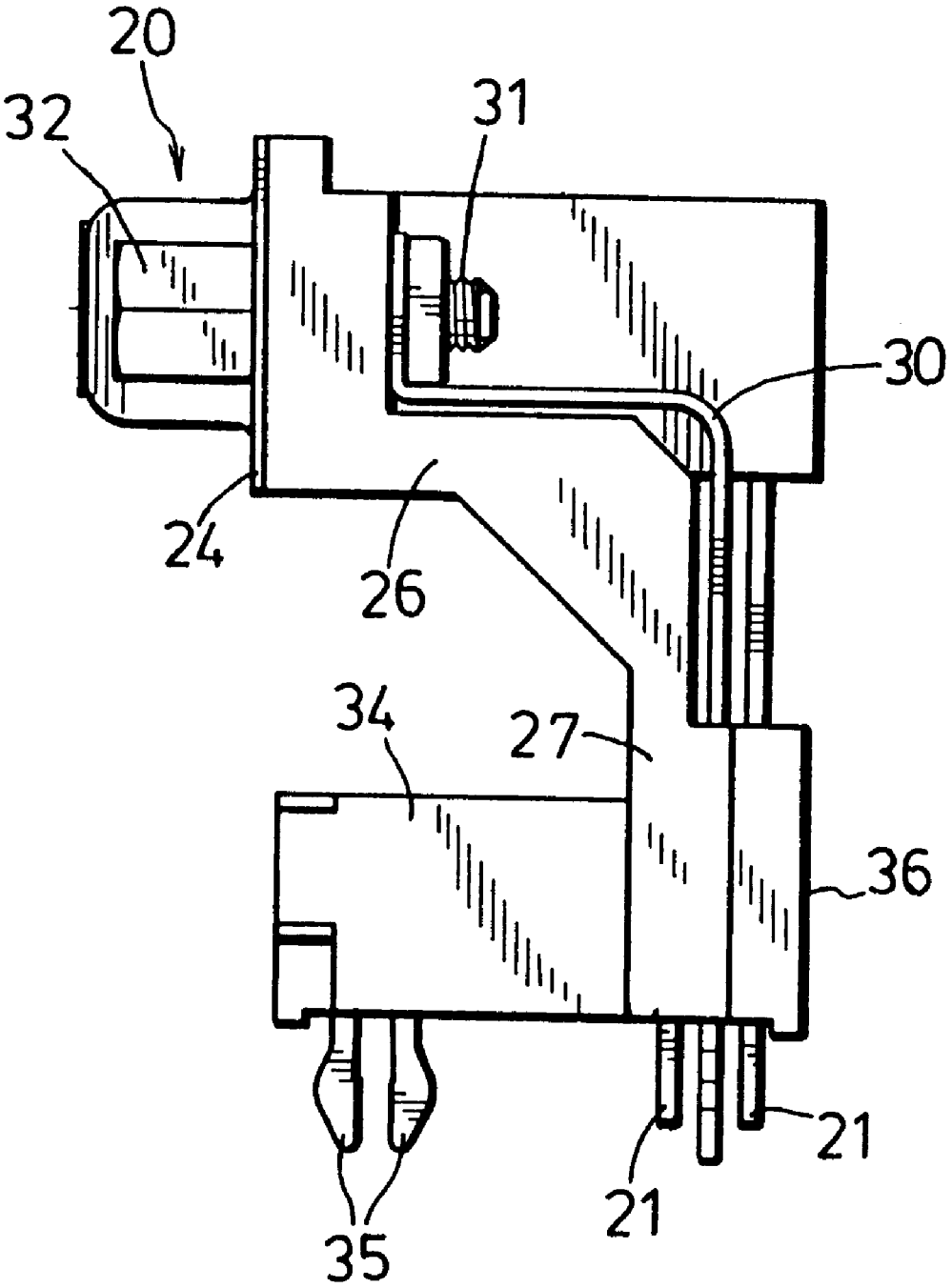
FIG. 7 is a schematic side view of the electrical connector assembly of the preferred embodiment.

As shown in FIGS. 2 and 7, after a metal shield 24 is mounted on the front side of the connector block portion 220, the bolts 32 are inserted through the holes 241, 25, 301 of the metal shield 24, the connector block portion 220 and the side anchoring terminals 30. The bolts 32 engage blind rivets 31 on the rear side of the connector block portion 220. The central anchoring terminal 35 is mounted to the foot member 34 to enhance stability of the electrical connector assembly 20 when mounted on the substrate.

Figure 4:
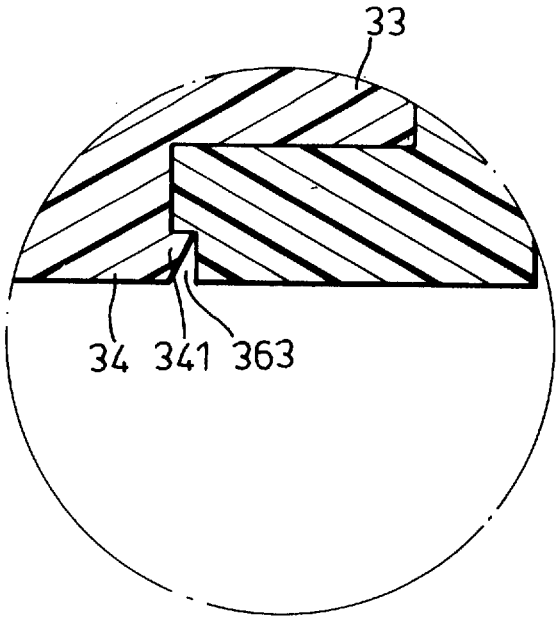
FIG. 4 is an enlarged schematic cross-section view showing the engagement between the main connector frame and a terminal positioning frame of the preferred embodiment.

As best shown in FIG. 4, in order to improve the fastening between the terminal positioning frame 36 and the main connector frame, the foot member 34 has a bottom portion formed with a rearward hook projection 341, which serves as a first fastener, and the terminal positioning frame 36 has a bottom side formed with an engaging groove 363 at its front edge, which serves as a second fastener. Engagement between the first and second fasteners 341, 363 secures mounting of the terminal positioning frame 36 on the main connector frame.

Figure 1:
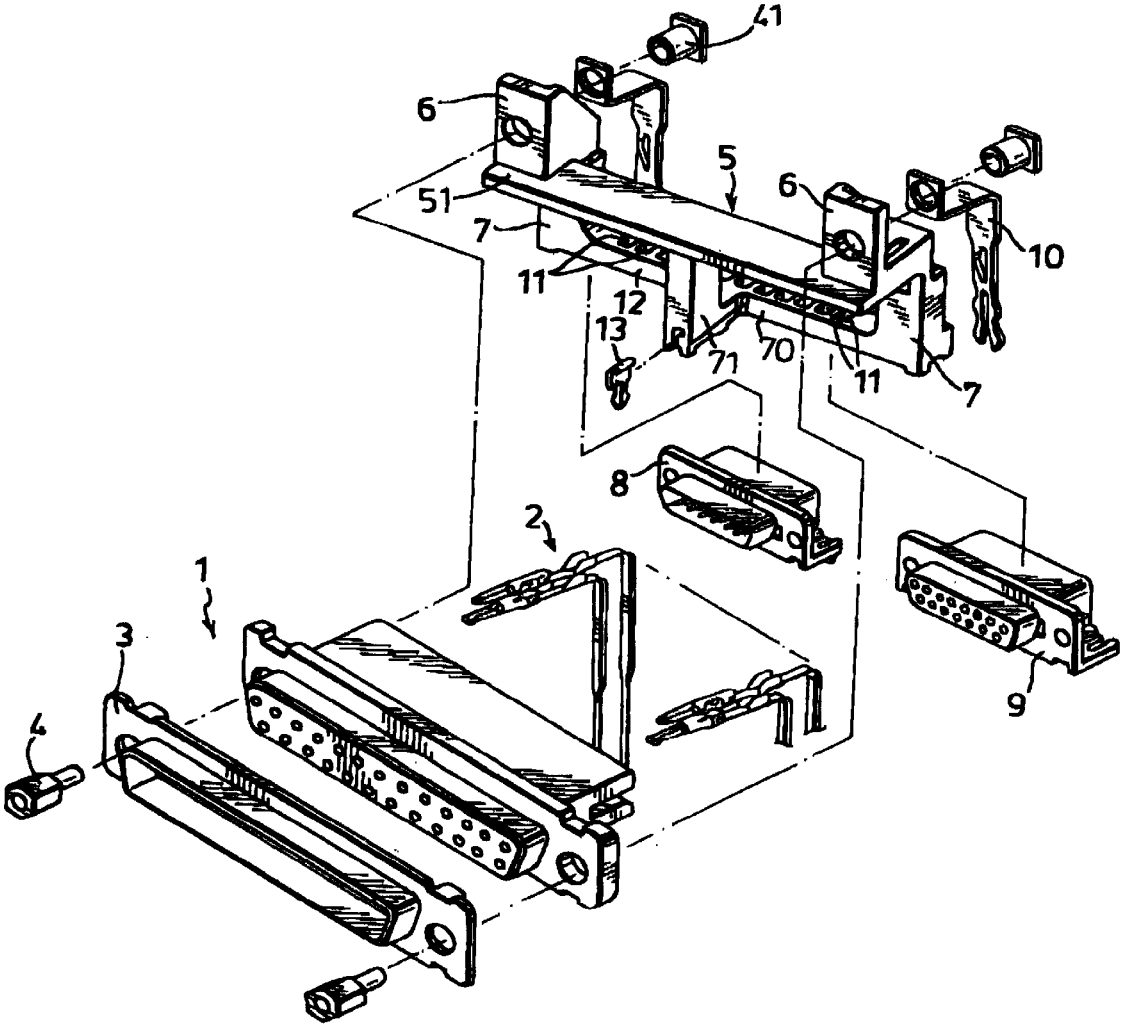
FIG. 1 PRIOR ART
FIG. 1 is an exploded view of a conventional stacked electrical connector assembly that utilizes an upright bracket.

According to this invention, since the main connector frame can be taken apart from the terminal positioning frame 36, in case one or more conductive terminals 21 are found to be defective before soldering to the substrate during the production stage, the defective terminals 21 can be easily replaced, and the complicated disassembly operations associated with the prior art of FIG. 1, in which the upper connector 1 must be removed from the bracket 5 prior to removal of the terminals 2 from the upper connector 1, can be dispensed with. Moreover, the provision of the guide plate 33 minimizes the possibility of bending or deformation of the conductive terminals 21, thus making it easier to insert the vertical solder tail portions of the conductive terminals 21 into the solder tail holes 361.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electrical connector assembly, comprising:

a plurality of conductive terminals, each of which has a horizontal contact portion with front and rear sections, and a vertical solder tail portion extending downwardly from said rear section of said horizontal contact portion; and a terminal housing including a main connector frame and a terminal positioning frame;

said main connector frame being formed integrally from an insulator material and including a connector block portion with front, rear and bottom sides, said bottom side having opposite left and right ends, said connector block portion being formed with at least one row of horizontal terminal holes that extend from said front side to said rear side for receiving said horizontal contact portions of said conductive terminals such that said vertical solder tail portions are behind said connector block portion, a spaced pair of parallel support arms extending downwardly from said bottom side of said connector block portion adjacent to said rear side and disposed respectively at said opposite left and right ends of said bottom side, said support arms having upper ends connected to said connector block portion and distal lower ends, said support arms cooperating with said connector block portion to confine an accommodating space adapted for accommodating an electrical connector below said connector block portion and in front of said support arms, and a guide plate connected to and extending between said distal lower ends of said support arms, said guide plate having horizontal major surfaces with front and rear edges, said guide plate being formed with a plurality of notches that extend from said rear edge toward said front edge to permit said vertical solder tail portions of said conductive terminals to extend downwardly through said guide plate;

said terminal positioning frame being formed integrally from an insulator material and being formed separately from said main connector frame, said terminal positioning frame being disposed below said guide plate and being formed with at least one row of solder tail holes that have vertical axes, said solder tail holes being registered with said notches in said guide plate to permit extension of said vertical solder tail portions of said conductive terminals therethrough.

2. An electrical connector assembly as claimed in claim 1, further comprising a pair of first anchoring terminals mounted respectively on said support arms and adapted for mounting said main connector frame on a circuit board.

3. An electrical connector assembly as claimed in claim 2, wherein said terminal positioning frame has opposite ends formed with a pair of upright clamping plates for clamping said first anchoring terminals against said support arms.

4. An electrical connector assembly as claimed in claim 2, wherein said main connector frame further includes a foot member extending forwardly and transversely from said guide plate between said support arms, said foot member being provided with a second anchoring terminal adapted for mounting said main connector frame on a circuit board.

5. An electrical connector assembly as claimed in claim 4, further comprising a first fastener provided on said foot member, and a second fastener provided on said terminal positioning frame to engage said first fastener so as to mount said terminal positioning frame on said main connector frame.

6. An electrical connector assembly as claimed in claim 5, wherein said foot member has a bottom portion formed with a rearward hook projection that serves as said first fastener, and said terminal positioning frame has a bottom side with a front edge which is formed with an engaging groove that serves as said second fastener.

7. An electrical connector assembly as claimed in claim 1, wherein said solder tail holes taper gradually in a vertical downward direction.

8. An electrical connector assembly as claimed in claim 1, wherein:

said connector block portion is formed with upper and lower rows of said horizontal terminal holes, said terminal holes in said upper row being staggered relative to said terminal holes in said lower row; and said notches in said guide plate include longer notches for passage of said vertical solder tail portions of said conductive terminals that have said horizontal contact portions thereof received in said lower row of horizontal terminal holes, and shorter notches that are shorter than and that are staggered with respect to said longer notches, said shorter notches permitting passage of said vertical solder tail portions of said conductive terminals that have said horizontal contact portions thereof received in said upper row of horizontal terminal holes.

* * * * *